US005694028A

United States Patent [19]

Salmonson et al.

[11] Patent Number: 5,694,028

[45] Date of Patent: Dec. 2, 1997

[54] METHOD AND APPARATUS FOR ADJUSTING THE POWER SUPPLY VOLTAGE PROVIDED TO A MICROPROCESSOR

[75] Inventors: Richard B. Salmonson; Robert J. Greener; Mark Ronald Sikkink; Robert J. Lutz; Max C. Logan, all of Chippewa Falls; Richard G. Finstad, Eau Claire, all of Wis.

[73] Assignee: Cray Research, Inc., Eagan, Minn.

[21] Appl. No.: 650,337

[22] Filed: May 20, 1996

[51] Int. Cl.[6] ..... G05F 1/44

[52] U.S. Cl. ..... 323/273; 323/282

[58] Field of Search ..... 323/272, 275, 323/282, 280, 287

[56] References Cited

U.S. PATENT DOCUMENTS 4,325,111 4/1982 Quiogue ..... 363/17

*Primary Examiner*—Peter S. Wong

*Assistant Examiner*—Rajnikant B. Patel

*Attorney, Agent, or Firm*—Schwegman, Lundberg, Woessner & Kluth, P.A.

[57] ABSTRACT

A method and apparatus for adjusting power supplied to a device when the device has a first and a second power input. A first voltage level and a ground potential are provided and a second voltage level is created as a function of the first voltage level. The second voltage level is then buffered with a power transistor and, if the second voltage level is needed for a particular device, the buffered second voltage level is selectively applied to the device. The circuit is disabled when the second voltage supply is not needed.

5 Claims, 5 Drawing Sheets

METHOD AND APPARATUS FOR ADJUSTING THE POWER SUPPLY VOLTAGE PROVIDED TO A MICROPROCESSOR

STATEMENT REGARDING GOVERNMENT RIGHTS

The present invention was made with government support under MDA 972-95-3-0032, awarded by ARPA. The Government has certain rights in this invention.

FIELD OF THE INVENTION

The present invention relates to a method and apparatus for microprocessors and more specifically to a voltage regulator circuit which can be used to adjust the power supply voltage provided to a microprocessor.

BACKGROUND OF THE INVENTION

A number of high speed electronic digital computers have been built utilizing the EV5 microprocessor available from Digital Equipment Corp. (DEC). The DEC EV5 processor requires only one power supply voltage, 3.3 volts DC. The circuit module and the power supply system were in turn designed to accommodate this single voltage requirement.

An improved microprocessor, the DEC EV56 processor, has been developed which provides much greater performance than the EV5 processor. However, this microprocessor requires two separate power supply voltages to properly function, one for the I/O circuitry and the other for the internal processor circuitry.

Providing a separate power supply for each power supply voltage is costly and cumbersome. What is needed is a way of designing a processor module that would permit the efficient and interchangeable use of either a single voltage or a dual voltage microprocessor in a single module design.

SUMMARY OF THE INVENTION

The present invention teaches a method and apparatus for adjusting power supplied to a device when the device has a first and a second power input. A first voltage level and a ground potential are provided and a second voltage level is created as a function of the first voltage level. The second voltage level is then buffered with a power transistor and, if the second voltage level is needed for a particular device, the buffered second voltage level is selectively applied to the device.

According to one aspect of the present invention, the first and second voltage levels are applied to first and second voltage planes, respectfully. If the second voltage level is needed by a particular device, a power transistor is plugged into the board. One of the outputs of the power transistor is then connected to the second voltage plane and used to drive the buffered second voltage level. An impedance is also connected between the first and the second voltage planes acts to reduce noise. If the second voltage level is not required, the power transistor can be removed from the board. In that situation, it can be advantageous to short the first and second voltage planes together to reduce noise.

DESCRIPTION OF THE PREFERRED EMBODIMENT

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
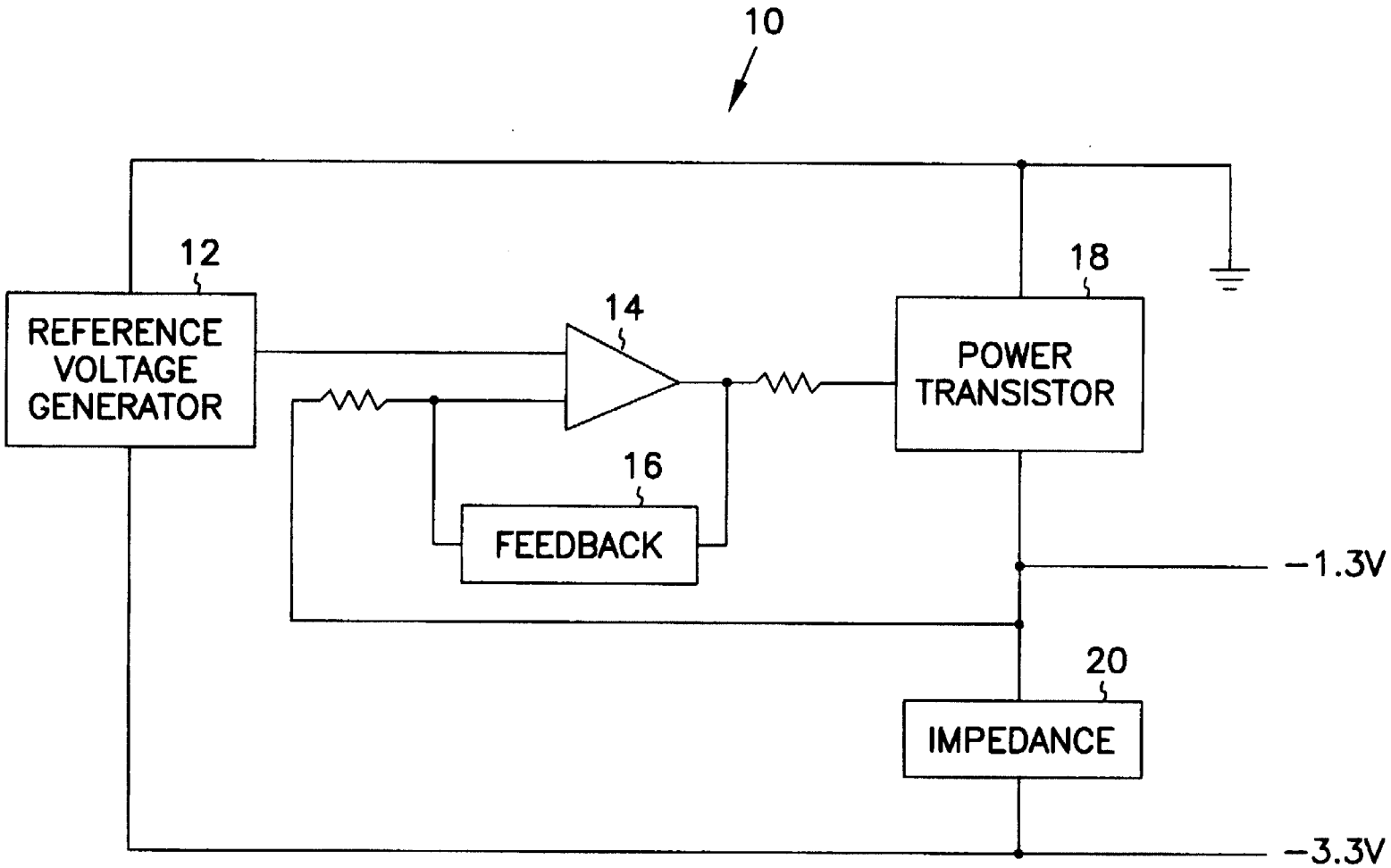
FIG. 1 is a schematic diagram illustrating a voltage regulator circuit according to the present invention.

FIG. 1 is a schematic diagram illustrating a voltage regulator circuit 10 which can be used to provide the second power supply needed to power a two voltage level microprocessor such as the DEC EV56. Voltage regulator circuit 10 includes a reference voltage generator 12, an operational amplifier 14, feedback circuit 16 and power transistor 18. The EV56 requires a 2 volt power supply to power its I/O circuitry and a 3.3 volt power supply to drive the rest of its circuitry. In the system of FIG. 1, the two voltages are shown developed between the −1.3 V and the −3.3 V lines and the ground and −3.3 V lines, respectively. In one embodiment, an impedance 20 is connected between the −1.3 V and the −3.3 V lines.

Reference voltage generator 12 is used to create a reference voltage. That reference voltage is fed in turn through amplifier 14 to power transistor 18. Power transistor 18 provides the current needed by the devices connected to the second voltage level. Feedback circuit 16 is used to prevent amplifier 14 from going into oscillation.

Figure 2:
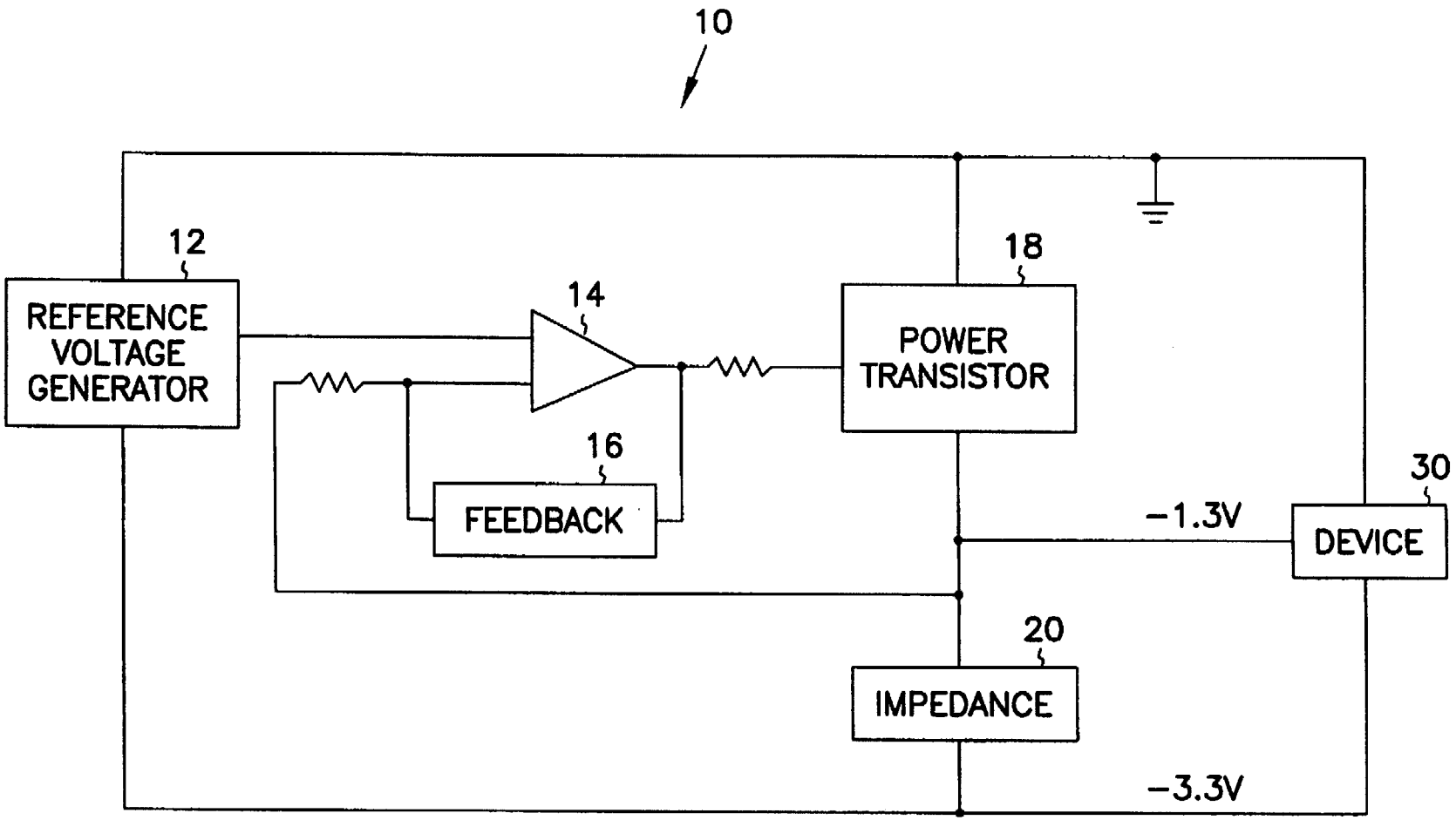
FIG. 2 is a schematic diagram of a circuit board module in which the voltage regulator circuit of FIG. 1 applied to supply two different voltage levels to a device such as a microprocessor.
Figure 3:
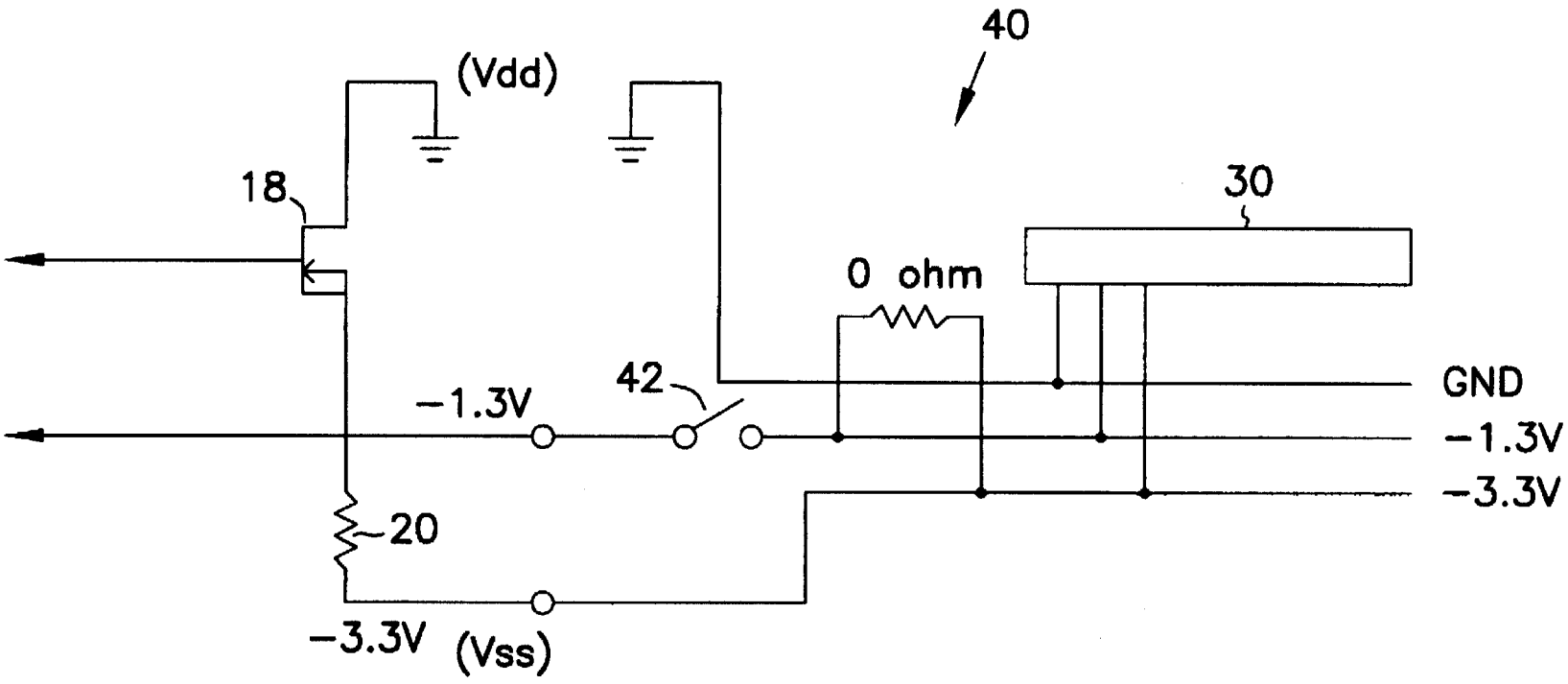
FIG. 3 is a schematic diagram illustrating one embodiment of the printed circuit module shown in FIG. 2.

An illustration of how voltage regulator circuit 10 is used is given in FIG. 2. In FIG. 2, a dual voltage device 30 is connected to the ground, −1.3 V and −3.3 V lines. In one embodiment, as is shown in FIG. 3, a printed circuit board 40 is designed having separate ground, −1.3 V and −3.3 V busses or planes. In one such embodiment, for situations where the second voltage level is not needed, power transistor 18 can be disconnected from the −1.3 V bus or plane and a zero ohm resistor connected between the −1.3 V and −3.3 V planes to minimize noise. This can be done, for instance, when using the DEC EV5 rather than the DEC EV56. In one embodiment a switch 42 is used to disconnect power transistor 18 from the −1.3 V bus or plane when that plane is not in use. In another embodiment, power transistor 18 is removed from printed circuit board 40 (or not inserted at fabrication) when the plane is not being used.

Figure 4:
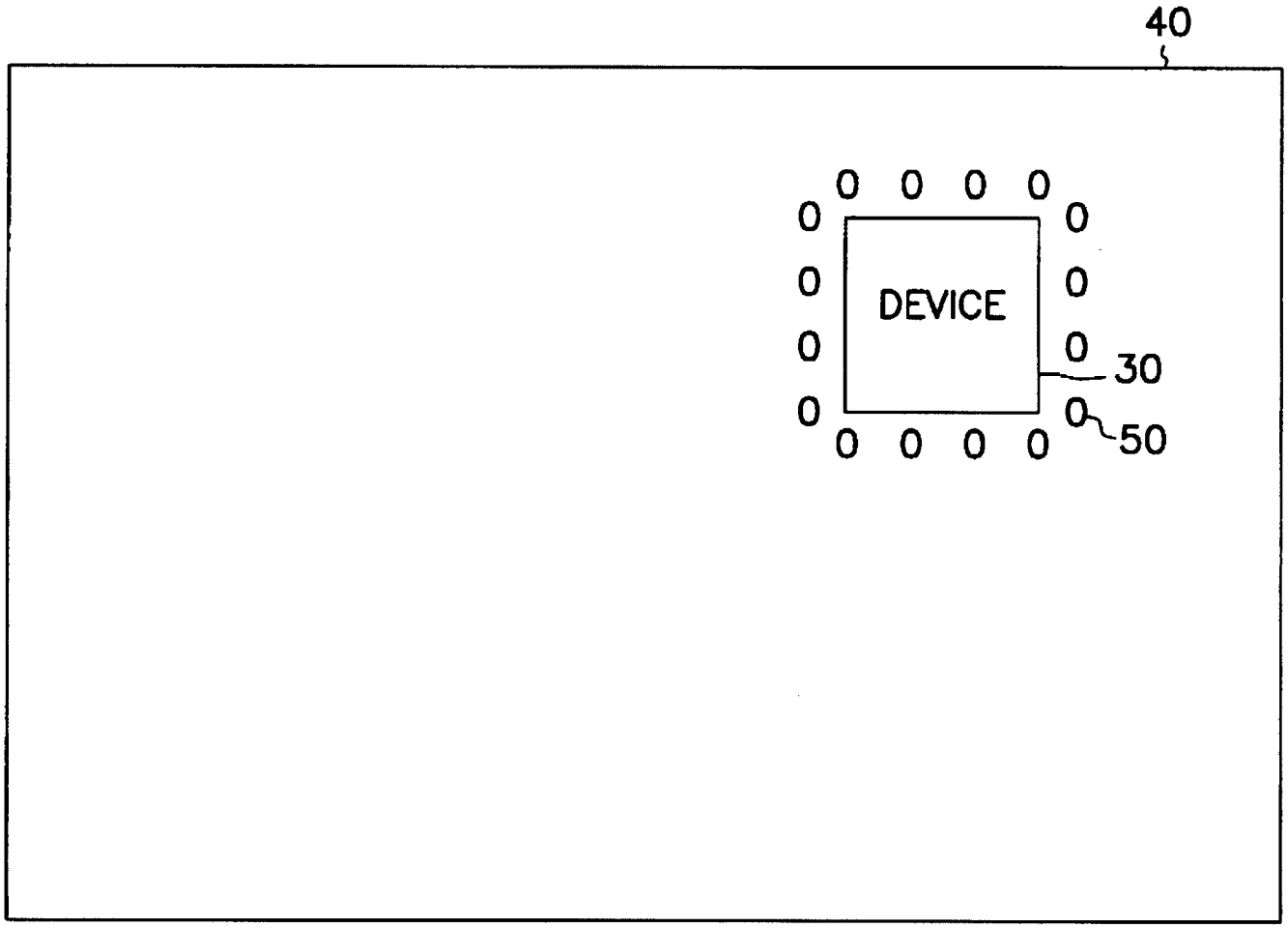
FIG. 4 is a top level view of one embodiment of the printed circuit module shown in FIGS. 2 and 3.

In one such embodiment, as is illustrated in FIG. 4, connections 50 are provided surrounding device 30 (or a socket that will contain device 30) to efficiently short the −1.3 V and −3.3 V voltage planes. In one embodiment, connections 50 are connected to the −1.3 V and −3.3 V planes such that adjacent connections 50 are connected to different voltage planes. These connections 50 may take the form of pads or vias. The step then of shorting the two voltage planes is performed by shorting adjacent connections 50. This provides an excellent low impedance connection between the two planes.

Figure 5:
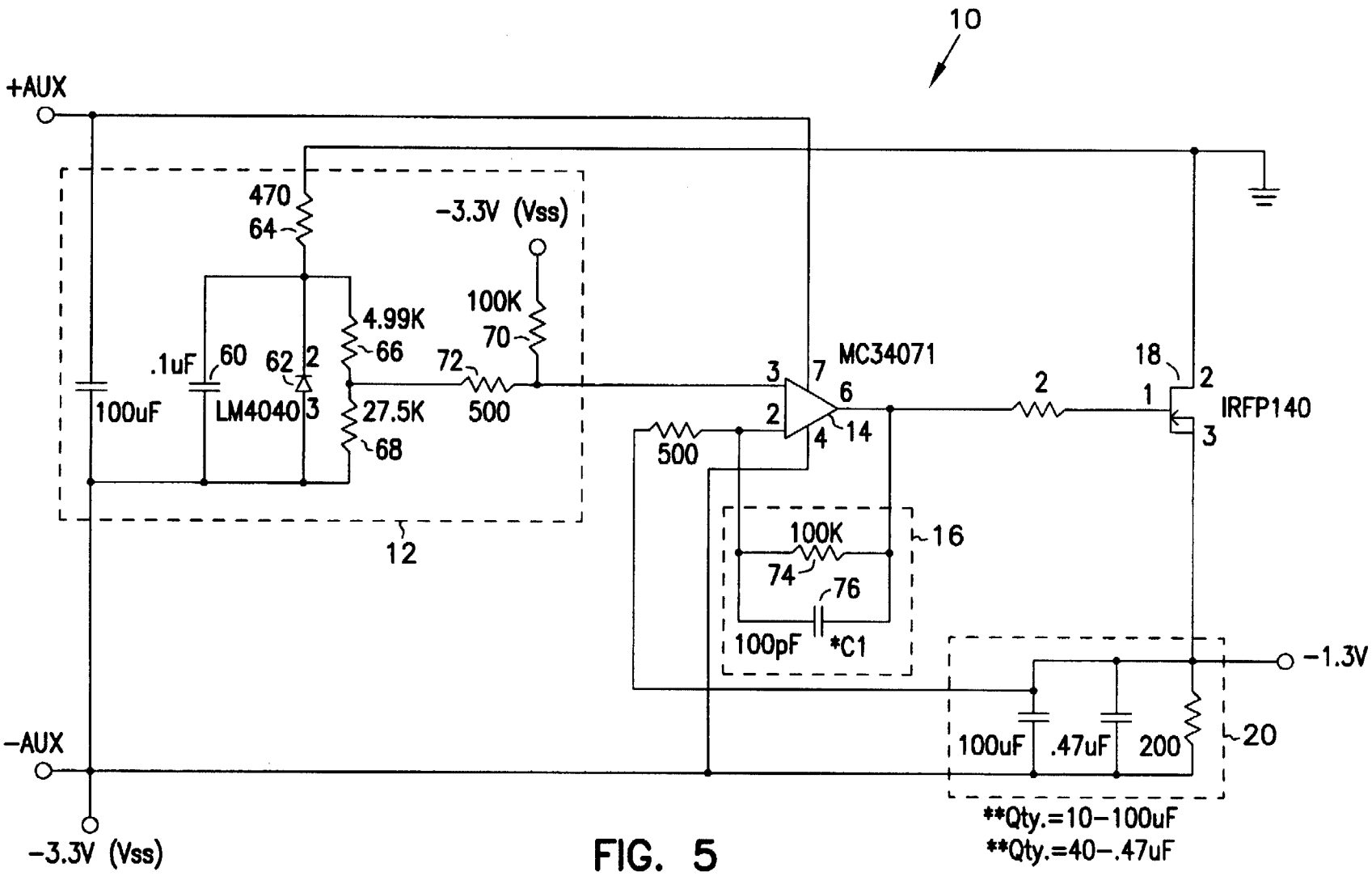
FIG. 5 is a schematic diagram illustrating one embodiment of the circuit of FIG. 1.

One embodiment of voltage regulator circuit 10 is shown in FIG. 5. In the circuit of FIG. 5, reference voltage generator 12 includes a capacitor 60 and a diode 62 connected to the −3.3 V plane. Capacitor 60 and diode 62 are connected through resistor 64 to the ground plane. In the resistance network of resistances 66, 68, 70 and 72 shown in FIG. 5, the resistances are sized to provide the desired reference voltage (in this case, a voltage potential which is two volts above the −3.3 V plane). In one embodiment, feedback circuit 16 is formed by connecting a resistance 74 and a phase compensation capacitor 76 in parallel. Phase compensation capacitor 76 provides the phase shift necessary to prevent oscillation.

In one embodiment, operational amplifier 14 is an MC34071 available from Motorola Inc., Phoenix, Ariz. and power transistor 18 is an IRFP140 available from International Rectifier, El Segundo, Calif. The on resistance (RDS) of the IRFP140 is a significant factor in determining the dominant pole of circuit 10. If a different device is used for power transistor 18, the value of phase compensation capacitor 76 may need to be adjusted. In such an embodiment, a DC regulation of +/−4 mV and a transient response of +/−45 mV were obtained during an HSPICE simulation using a constant current source of 5 amps and a sink/source of 4 amps with a linear ramp over a 5 ns period.

Voltage regulator circuit 10 shown in FIG. 5 has been shown to be a stable (not oscillatory) design which can be used to efficiently supply power to a printed circuit module needing two levels of power. At the same time, circuit 10 can be disabled simply by disconnecting power transistor 18 from the −1.3 V voltage plane (or by removing transistor 18 from the module completely). Therefore a module designed to include voltage regulator circuit 10 can be used to design a processor module that would permit the efficient and interchangeable use of either a single voltage or a dual voltage microprocessor in a single module design. Circuit 10 meets the high electrical requirements of both the DEC EV5 and the DEC EV56 without requiring the addition of a separate power supply. In addition, circuit 10 is active only when the EV56 is present and is inactive when the EV5 is present.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A voltage regulation circuit for operation in a system having a power supply providing a first voltage level and a ground potential, wherein the circuit comprises:

a reference voltage generator, wherein the reference voltage generator creates a second voltage level based on said first voltage level;

an operational amplifier circuit connected to the reference voltage generator, wherein the operational amplifier circuit includes an operational amplifier and an operational amplifier feedback circuit, wherein the operational amplifier includes a first and a second input and an output and wherein the operational amplifier feedback circuit is connected between said output and said second input;

a power transistor, wherein the power transistor includes a transistor input and a transistor output, wherein the transistor input is connected to the output of said operational amplifier;

an impedance; and means for connecting said impedance between the first voltage level and the output of the power transistor.

2. A circuit board module for operation in a system having a power supply providing a first voltage level and a ground potential, comprising:

a first voltage level bus connected to the first voltage level;

a ground bus connected to the ground potential;

a reference voltage generator, wherein the reference voltage generator creates a second voltage level based on said first voltage level;

an operational amplifier circuit connected to the reference voltage generator, wherein the operational amplifier circuit includes an operational amplifier and an operational amplifier feedback circuit, wherein the operational amplifier includes a first and a second input and an output and wherein the operational amplifier feedback circuit is connected between said output and said second input;

a power transistor, wherein the power transistor includes a transistor input and a transistor output, wherein the transistor input is connected to the output of said operational amplifier;

a second voltage level bus connected to the output of the power transistor;

an impedance; and means for connecting said impedance between said first and said second voltage level busses.

3. A method of adjusting power supplied to a device having a first and a second power input, the method comprising the steps of:

providing a first voltage level and a ground potential;

connecting the first voltage level to the first power input;

generating a second voltage level based on said first voltage level;

buffering the second voltage level;

determining if the device requires both the first and the second voltage level; and if the device requires both the first and the second voltage level, connecting the buffered second voltage level to the second power input.

4. The method according to claim 3 wherein the step of connecting the buffered second voltage level includes the step of connecting an impedance greater than approximately 50 ohms between the first voltage level and the buffered second voltage level.

5. The method according to claim 3, wherein the method further comprises the step of connecting an approximately zero impedance between the first voltage level and the buffered second voltage level if the device does not require both the first and the second voltage level.

* * * * *